United States Patent [19]

Skinner

[11] 4,146,205

[45] Mar. 27, 1979

[54] ASSEMBLY SKID

[75] Inventor: Harvey G. Skinner, Ligonier, Pa.

[73] Assignee: Westmoreland Plastics Company, Latrobe, Pa.

[21] Appl. No.: 329,666

[22] Filed: Feb. 5, 1973

[51] Int. Cl.[2] ..... A47B 91/00; B65D 19/22; B65D 19/26

[52] U.S. Cl. ..... 248/346; 206/320; 206/386; 108/56.1; 108/901

[58] Field of Search ..... 206/521, 386, 320, 326, 206/599; 229/14 C; 217/43 A; 220/72; 108/51, 58, DIG. 1, 56.1, 901; 248/300, 219 R, 346; 214/10.5 R

[56] References Cited

U.S. PATENT DOCUMENTS

| | | | |
|---|---|---|---|
| 3,023,885 | 3/1962 | Kindseth | 229/14 C |
| 3,047,137 | 7/1962 | Kindseth | 206/521 |
| 3,128,979 | 4/1964 | Damelio | 248/300 |
| 3,148,797 | 9/1964 | Cloyd | 220/72 |
| 3,277,849 | 10/1966 | Talbot | 108/58 |
| 3,433,184 | 3/1969 | Addy | 108/58 |
| 3,580,467 | 5/1971 | Pieszak et al. | 229/14 C |
| 3,664,570 | 5/1972 | Kupersmit | 217/43 A |
| 3,709,160 | 1/1973 | Howard et al. | 108/51 |

*Primary Examiner*—William T. Dixson, Jr.
*Attorney, Agent, or Firm*—Buell, Blenko & Ziesenheim

[57] ABSTRACT

A skid adapted to be attached to the bottom pan of an appliance to facilitate travel along an assembly line has an elongated central portion terminating at each end in a platform which extends beyond the corner of the bottom pan at each side so as to form a base for a corner support column in the shipping carton. The skid becomes a part of the shipping package.

7 Claims, 3 Drawing Figures

ASSEMBLY SKID

This invention relates to skids for appliances which are assembled while travelling along an assembly line. It is more particularly concerned with such skids which are also adapted to position the appliance in a shipping carton and form a part thereof.

Like automobiles, appliances such as ranges, refrigerators, air conditioners and the like are commercially fabricated by assembly line methods. Appliances, conventionally bolted to boards or wooden frames and are normally passed over conveyors of different types such as roller conveyors, belt conveyors and others in the course of their manufacture, and when finished are transferred into shipping cartons. It is necessary to space the appliance from the walls of the shipping carton because the latter are not strong enough to support the weight of loaded cartons stacked on them, and are reinforced with corner columns, usually of laminated corrugated board of some description. To save expense, the boards or frames are made of poor quality green lumber which is frequently rough surfaced, and tends to warp. When the boards strike the conveyor mechanism they sometimes splinter or split. Because of these various defects in their supporting means movement of the appliances over the conveyors is often impeded. In the shipping carton, especially when the appliance is not delivered for some time, the green lumber tends to dry out and shrink, which sometimes allows the reinforcing columns to become dislodged.

It is an object of my invention to provide an assembly skid for appliances which is inexpensive and which facilitates the movement of the appliances over conveyors of various types. It is another object to provide such a skid which positions the appliance in its shipping carton and forms a part thereof. It is still another object to provide such a skid which provides a firm base for corner support columns in the shipping carton. Other objects will appear in the course of the description of my invention which follows.

The skid of my invention has a channel-section central portion terminating at each end in flat-surfaced platforms which extend outwardly from the sides and end of the central portion and are reinforced by a skirt extending around their sides and end and depending to the same depth as the channel flanges. The outer edges of those flanges have outwardly turned-over flat margins, and the central portion is reinforced by longitudinally extending ribs within the channel. Each platform is provided with a mounting hole, the distance between the holes being that of mounting holes in the bottom pan of the appliance. A skid is attached to the bottom pan by bolts through these holes, generally one skid on each long side of the pan. The platform extends beyond the bottom pan corners so as to space the appliance from the walls of a shipping carton and to provide the base for a reinforcing column within the carton.

An embodiment of my invention presently preferred by me is illustrated in the attached figures, to which reference is now made.

Figure 2:
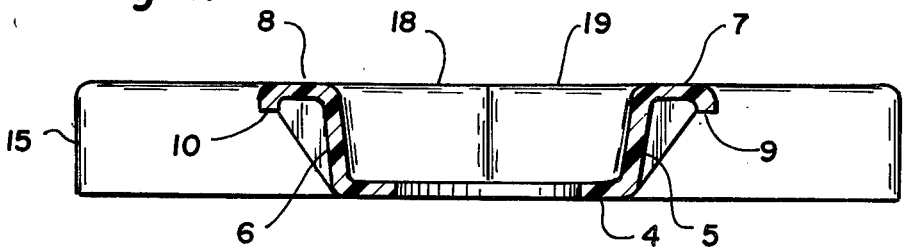
FIG. 2 is a cross-section to an enlarged scale of the article of FIG. 1 taken on the plane 2—2 of FIG. 1.
Figure 3:
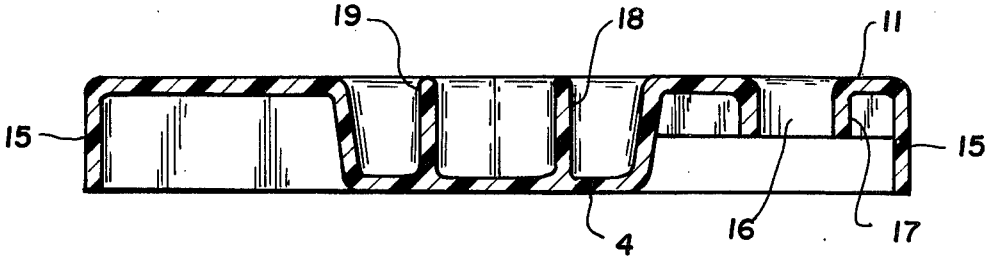
FIG. 3 is a cross-section to the same scale as FIG. 2 of the article of FIG. 1 taken on the plane 3—3 of FIG. 1.

My article comprises an elongated central section 1 terminating at each end in identical platforms 2 and 3 of greater width than section 1. Section 1 is channel-shaped, as may be seen from FIG. 2, having a flat bottom web 4 and upstanding flanges 5 and 6. The outer edges of those flanges are turned over into outwardly projecting flat margins 7 and 8, respectively, which are parallel to web 4. Each margin 7 and 8 is provided with a curled over border, 9 and 10 respectively.

Figure 1:
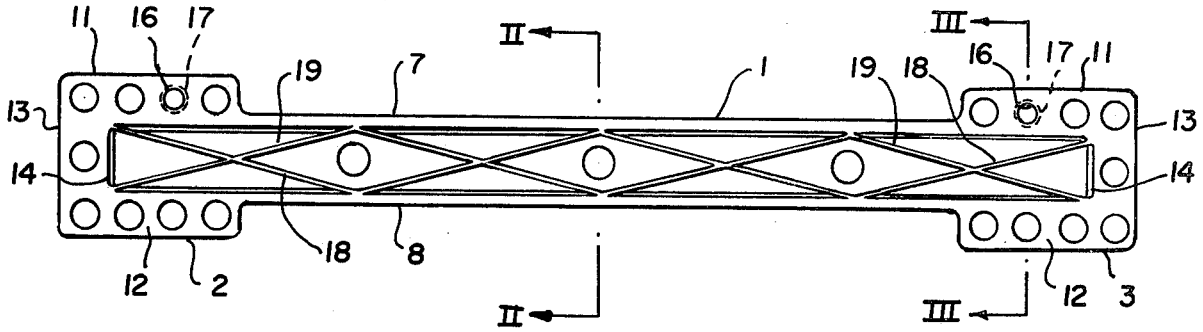
FIG. 1 is a plan view of an assembly skid of my invention.

Platform 2, as may be seen from FIG. 1, comprises outward extensions 11 and 12 respectively of margins 7 and 8 which continue and meet around the end 14 of central section 1 in outward extension 13 thereof. A skirt 15 depends around the entire periphery of platform 2 to the same depth as that of flanges 5 and 6 of section 1. Platform 3 is identical in structure to platform 2, and the portions of platform 3 corresponding with those of platform 2 are designated, where necessary, by the reference characters applied to platform 2.

Platform 2 is provided with a mounting hole 16 in its outward extension 11 and platform 3 is provided with a corresponding mounting hole 16. A skirt or bushing 17 depends around the circumference of each hole 16 to a depth less than that of flanges 5 and 6.

Central section 1 is provided with two longitudinally extending ribs 18 and 19 which project upwardly from web 4 a distance equal to the depth of flanges 5 and 6. Ribs 18 and 19 are not parallel to each other or to flanges 5 and 6, but criss-cross several times throughout the length of the section 1 to form a diamond pattern between the flanges and provide diagonal reinforcement therefor.

In use, one of my skids is bolted to the bottom pan of the appliance along oneside thereof through holes 16—16 and another along the other long side in the same way. The bolt heads or nuts bear against skirt 17 and do not project below web 4. My article is dimensioned so that outward extensions 11 or 12, and 13 extend or project beyond the corners of the pan. The pan thus supported is moved over the assembly conveyors while the appliance is being assembled, the flat outer suface of web 4 facilitating such movement. When the appliance is completed it is transferred, still on the skids of my invention, into a shipping carton where it is spaced from the carton walls by the extensions 11, 12 and 13 of platform portions 2 and 3 of the skids. Those extensions are dimensioned so as to leave room for vertical reinforcing columns at the corners of the carton and to provide a base upon which each such column rests, so that the skid becomes a part of the package. Skirt 15 transmits the column load to the bottom of the shipping carton.

My skid may be made from metal or plastic, and in its latter form is conveniently produced by casting in a mold.

In the foregoing specification I have described a presently preferred embodiment of this invention, however, it will be understood that this invention can be otherwise embodied within the scope of the following claims.

I claim:

1. A skid adapted for use in pairs, one on each of two opposite sides of a bottom pan of an article and below the bottom pan, each adapted to support one side of the bottom pan of an article while it travels along an assembly line and is assembled thereon and to form a part of the base of the article's shipping package each skid comprising an elongated flat bottomed central portion terminating at each end in a platform wider than the central portion but of the same depth and extending beyond the bottom pan at each end and side so as to space it from the sides of the shipping container and to form a base for corner support columns therein.

2. The skid of claim 1 in which the central portion at each end extends into the terminal platform.

3. The skid of claim 1 in which the central portion is channel-shaped.

4. The skid of claim 3 in which the upstanding flanges of the channel are turned over into outwardly projecting flat margins.

5. A skid adapted for use in pairs, each adapted to support one side of the bottom pan of an article while it travels along an assembly line and is assembled thereon and to form a part of the article's shipping package each skid comprising an elongated flat bottomed central portion terminating at each end in a platform wider than the central portion but of the same depth and extending beyond the bottom pan at each end and side so as to space it from the sides of the shipping container and to form a base for corner support columns therein, each platform being provided around both sides and outer end with a reinforcing skirt depending to the plane of the bottom of the central portion.

6. A skid adapted for use in pairs, each adapted to support one side of the bottom pan of an article while it travels along an assembly line and is assembled thereon and to form a part of the article's shipping package each skid comprising an elongated flat bottomed central portion terminating at each end in a platform wider than the central portion but of the same depth and extending beyond the bottom pan at each end and side so as to space it from the sides of the shipping container and to form a base for corner support columns therein, said central portion being channel-shaped and the upstanding flange of the channel being turned over into outwardly projecting flanges and the channel-shaped central portion being provided with upstanding reinforcing ribs.

7. The skid of claim 6 in which the upstanding reinforcing ribs criss-cross to form a diamond pattern reinforcement between the flanges.

* * * * *